US006752632B1

(12) United States Patent
Anderson et al.

(10) Patent No.: US 6,752,632 B1
(45) Date of Patent: Jun. 22, 2004

(54) CONNECTOR INTERFACE PAD FOR STRUCTURALLY INTEGRATED WIRING

(75) Inventors: David M. Anderson, Issaquah, WA (US); David R. Gladish, Bellevue, WA (US); Robert T. Johnson, Everett, WA (US); Kenneth H. Griess, Renton, WA (US); Gerald F. Herndon, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/393,744

(22) Filed: Mar. 21, 2003

(51) Int. Cl.[7] ..... H01R 33/00
(52) U.S. Cl. ..... 439/34; 174/66
(58) Field of Search ..... 439/404, 563, 439/562, 569, 510, 538, 539, 34, 37, 98, 537, 536, 570, 901, 529, 530, 542, 543, 544, 564, 565, 566, 567, 247, 248; 174/66, 67

(56) References Cited

U.S. PATENT DOCUMENTS 4,810,207 A * 3/1989 Butterfield ..... 439/529
6,139,346 A * 10/2000 Cecil et al. ..... 439/247
6,514,095 B1 * 2/2003 Smith et al. ..... 439/306

* cited by examiner

*Primary Examiner*—Ross Gushi
(74) *Attorney, Agent, or Firm*—Harness, Dickey & Pierce P.L.C.

(57) ABSTRACT

A pin connector is provided including a housing having a central orifice and an annular skirt laterally projecting therefrom. The skirt is bondable over a structurally integrated pad with integral wiring array. An array of compliant pins are insertable within holes in the pad. A pin retainer is disposed within the central orifice and includes an array of through holes formed therethrough. The array of compliant pins is disposed within the through holes of the pin retainer. The central orifice is adapted to receive a mating connector such that an array of contacts associated with the mating connector insert within the through holes of the pin retainer to make electrical contact with the array of compliant pins in the pin connector.

18 Claims, 2 Drawing Sheets

CONNECTOR INTERFACE PAD FOR STRUCTURALLY INTEGRATED WIRING

FIELD OF THE INVENTION

The present invention relates to pin connectors for interfacing wirings and more particularly, to a compliant pin connector for providing a durable interface between structurally integrated wiring and non-structurally integrated wiring.

BACKGROUND OF THE INVENTION

Modern vehicles such as aircraft and space vehicles are beginning to employ a multitude of sensors and actuators to monitor vehicle performance and integrity, and to react or actuate various aspects of vehicle structure. : Structural integration of such sensors or active devices are part of technology development areas known as "Multifunctional Structures", "Smart Structures", and "Structural Health Monitoring". To accommodate integration sensor or actuator devices with structure, new "structurally integrated connector" designs are desired. Traditional connector designs are often inadequate.

Structurally integrated wiring and connectors can also be used to replace traditional round wiring to provide a lower cost, weight, and reduced space solution. Traditional wiring installations use round wire cable bundles. Such round wire cable bundle wiring is labor intensive, subject to human error, undesirably increases the weight and complexity of the vehicle, and can be prone to durability concerns when applied to new smart or multifunctional structures.

To avoid these drawbacks, structurally integrated wiring has recently been developed. The integrated wiring design approach uses a flat flex circuit (single layer, or multi-layer board) for the structurally integrated design. These wirings are bonded onto or within the structural components of the vehicle. This minimizes the number of attachment parts (brackets, clips, etc) and installation steps needed. These wirings also increase the potential for automated processing which reduces the potential for human error.

One area related to structurally integrated wirings that needs further development is a connector to interface between the structurally integrated wiring and non-structurally integrated wiring. Most health management devices and structurally integrated wirings are in a flat form: Such wiring is bonded onto the surface or into the laminate of a composite structure. The wiring is protected by the structure but also experiences the same mechanical or thermal strains of the structure to which it is attached. As such, it would be desirable to provide a connector that works in conjunction with the flat configuration of the structurally integrated wiring. It would also be desirable to provide a connector that that provides durable electrical contacts during structural straining.

SUMMARY OF THE INVENTION

The above and other objects are provided by a connector including a body having a central orifice and a skirt laterally projecting from a periphery of the body. The skirt provides a bondable surface for securing the connector to a surface adjacent a structurally integrated wiring. As such, the skirt extends away from the body by at least an amount equal to the shortest distance across the body. A contact retainer (which is known in the art as a pin block) is disposed within the central orifice and includes an array of through holes formed therethrough. An array of contacts in the form of pins, sockets or a combination thereof, which preferably have a compliant pin feature at the opposite end, are inserted within the through holes of the contact retainer. The compliant pin portion is inserted into a structurally integrated connector pad. The central orifice is adapted to receive a mating connector such that an array of contacts in the form of pins, contacts or a combination thereof, associated with the mating connector insert within the through holes of the contact retainer to make electrical contact with the array of contacts in the contact connector.

Further areas of applicability of the present invention will become apparent from the detailed description provided hereinafter. It should be understood that the detailed description and specific examples are intended for purposes of illustration only and are not intended to limited the scope of the invention.

BRIEF DESCRIPTION OF THE DRAWINGS

The present invention will become more fully understood from the detailed description and the accompanying drawings, wherein:

FIG. 3 is a cross-sectional view of the connector of the present invention embedded within a structure.

DETAILED DESCRIPTION OF THE PREFERRED EMBODIMENTS

The following description of the preferred embodiment is merely exemplary in nature and is in no way intended to limit the invention, its application, or uses.

Figure 1:
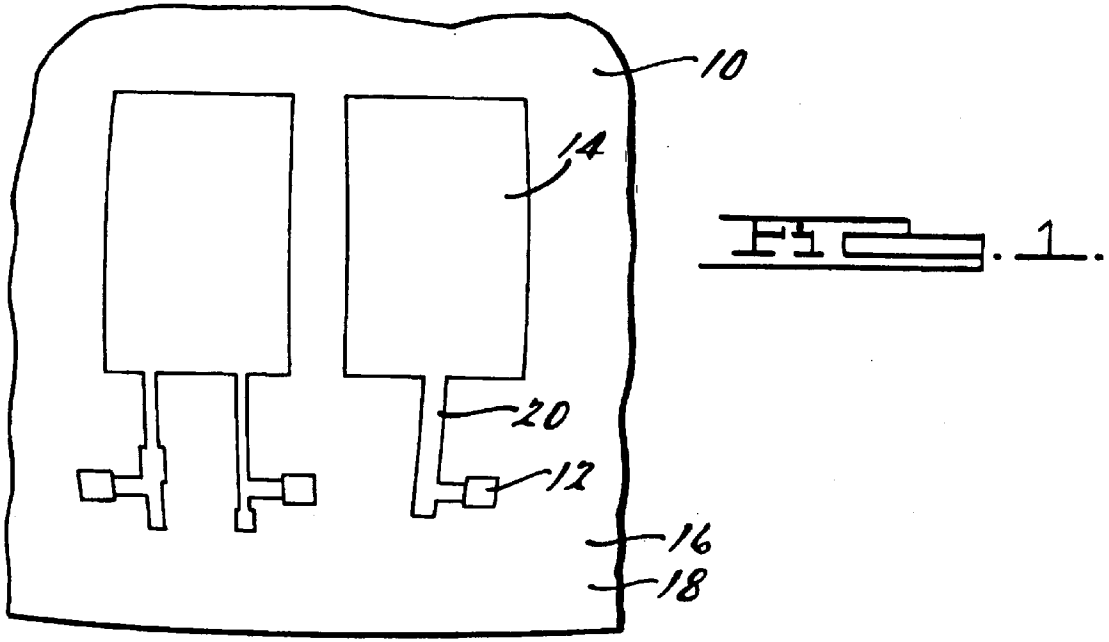
FIG. 1 is a side view of a vehicle having a connector pad suitable for interfacing with the connector of the present invention incorporated therein.

FIG. 1 illustrates a vehicle 10 in the form of an aircraft having a connector pad 12 mounted thereto. More particularly, an integrated actuator or sensor 14, such as a piezo actuator or acoustic piezo sensor is mounted to a structural surface 16 (such as a fuselage 18) of the vehicle 10 by bonding with an adhesive of the like. Although the sensor 14 is illustrated as being mounted to an outer surface of the fuselage 18, the sensor 14 could also be embedded therein. Embedding may be preferred if the fuselage is a composite laminated structure. On the other hand, surface mounting is likely preferred on metal or non-laminated structures.

A flat or flex circuit type wiring array 20 extends from the sensor 14 along the fuselage 18. The wiring array 20 is structurally integrated with the fuselage 18 by being bonded thereto by an adhesive or the like. Although the wiring array 20 is illustrated as being mounted to an outer surface of the fuselage 18, the wiring array 20 could also be embedded therein. Embedding is likely preferred if the fuselage is a composite laminated structure. On the other hand, surface mounting is likely preferred on metal or non-laminated structures.

The connector pad 12 is coupled to the wiring array 20. The connector pad 12 is structurally integrated with the fuselage 18 by being bonded thereto by an adhesive or the like. Although the connector pad 12 is illustrated as being mounted to an outer surface of the fuselage 18, the connector pad 12 could also be embedded therein. Embedding is preferred if the fuselage is a composite laminated structure. On the other hand, surface mounting is preferred on metal or non-laminated structures.

Figure 2:
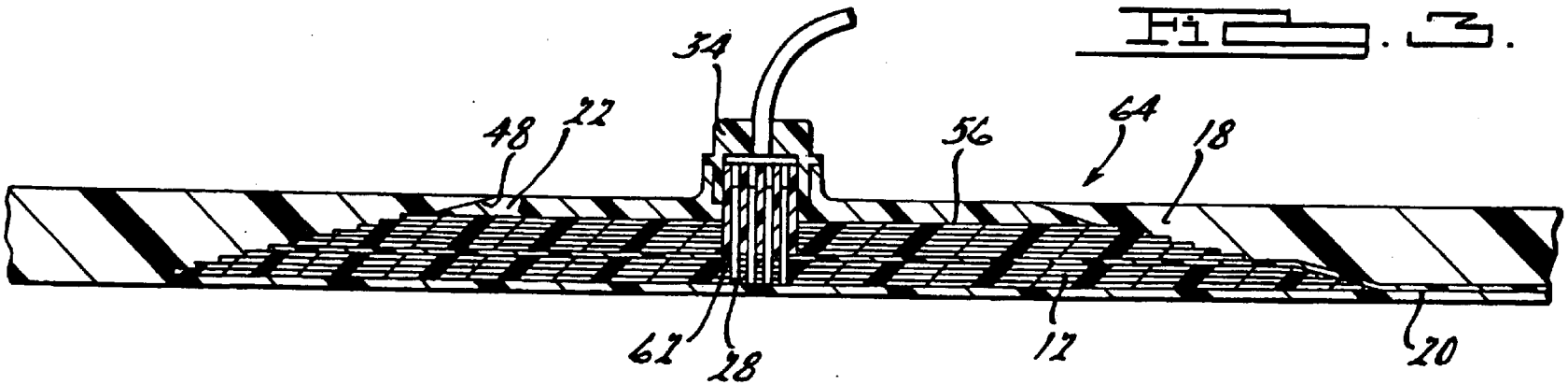
FIG. 2 is an exploded view of the connector of the present invention in association with a structurally integrated connector pad and flat wire, as well as a mating connector and wire.
Figure 2:
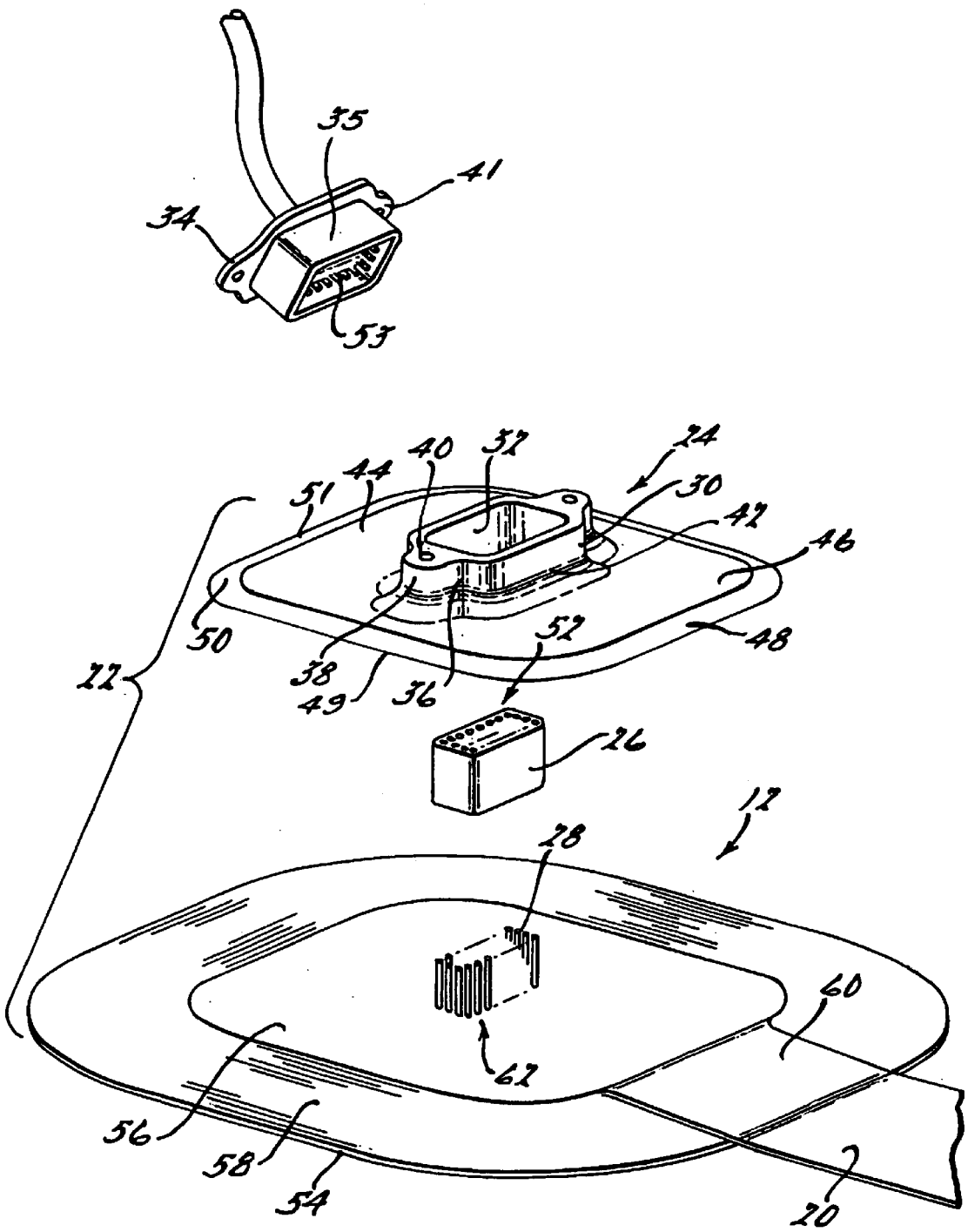

Turning now to FIG. 2, the connector 22 of the present invention is illustrated in greater detail. The connector 22 includes a housing 24, a contact retainer 26 (which is known in the art as a pin block), and an array of contacts in the form of compliant pins 28. Environmental seals (not illustrated) are located above and below the contact retainer 26.

More particularly, the housing 24 includes a generally rectangularly shaped columnar body 30 in the form of an upstanding enclosed wall having a central orifice 32 therein. The size and shape of the orifice 32 is designed to accommodate the size and shape of a mating connector 34 so as to snugly encircle a portion 35 of the mating connector and to clock orient the mating connector to ensure only one contact mating configuration is possible. In the preferred embodiment, the central orifice 32 and portion 35 are generally rectangularly shaped.

The two end walls 36 of the body 30 are essentially parallel one another and preferably include mounting bases 38 in the form of pedestal type appendages integrally formed therewith. Each mounting base 38 is generally hemicylindrically shaped and includes a threaded bore (or insert) 40 longitudinally formed therein from a top surface which is essentially coplanar with a top surface of the end walls 36 and remainder of the body 30. The threaded bores 40 are adapted to receive a threaded member (not shown) of the mating connector 34 therein. A complimentary shaped flange 41 of the mating connector 34 abuttingly engages the top surface of the body 30 when the mating connector 34 is secured to the housing 24.

The exterior corners between the end walls 36 and the sidewalls 42 of the housing 24 are preferably curved or rounded. This rounding reduces the possibility of stress fractures from occurring at these locations. The interior corners between the end walls 36 and the sidewalls 42 are also preferably curved or rounded. This rounding not only reduces the possibility of stress fractures but, when at least one corner is a unique radius, also provides a keying effect for properly orienting the mating connector 34 relative to the body 30.

By keying the mating connector 34 to the body 30, the potential for pin and signal mis-alignments and consequential damage therebetween are reduced. If desired, a guide in the form of one or more longitudinal ribs and one or more complimentary grooves may be provided on the interior of the wall 30 and on the exterior of the mating connector 32, respectively or visa versa. Such a guide may help ensure the mating connector 34 is properly inserted within the body 30.

The housing 24 also includes a generally rectangularly shaped annular flange in the form of a tapered lip or skirt 44 laterally extending about a periphery of a lower portion of the body 30. While the term annular is used herein to describe the configuration of the skirt 44, one skilled in the art should appreciate that a discontinuous or partial annular configuration is intended to be within the scope of the term annular as used herein. The annular skirt 44 preferably extends generally orthogonal relative to a longitudinal axis of the body 30. Notwithstanding, the annular skirt 44 may be angled relative to the body 30 if a tilted connection is desired.

The junction between the annular skirt 44 and the body 30 is preferably arcuate to reduce the possibility of stress fractures at these locations. The arcuate region preferably extends about the circumference of the body 30 including the sidewalls 42 and the mounting bases 38. By forming the skirt 44 integrally with the body 30 and mounting bases 38, the arcuate junctions may be readily formed.

The annular skirt 44 includes a first portion 46 extending from the body 30 to a second portion 48 terminating at a perimeter 49. The first portion 46 is preferably slightly tapered although it may also be planar, and the second portion 48 preferably tapers the remaining thickness to the edge. More particularly, in the slightly tapered first portion 46, the upper and lower surfaces of the skirt 44 are substantially parallel while in the tapered second portion 48, the upper surface converges relatively abruptly toward the lower surface.

The tapered first portion 46 offsets the body 30 from the perimeter 49 of the skirt 44 to increase the surface area of the skirt 44 available for bonding the housing 24 to another structure such as the connector pad 12 and/or embedding the connector 22 within a structure such as the fuselage 18 of FIG. 1. The size of the skirt is critical to ensure the bonded housing can withstand expected side, bending, and transverse forces imparted on the housing 24. Because the side force may vary greatly between environments, e.g., 100 lbs/in to 1500 lbs/in or more, the exact dimensions of the skirt can vary. Ideally, the connector housing will be a small as allowable to save space, weight and cost. For a connector with a small number of pins, the connector housing and skirt may be on the order of 1 inch. Yet a larger connector with significantly more pins may have a skirt size on the order of 6 to 8 inches. Since size reduction is often an important feature, having a miniature connector may also be desirable and practical for some applications; such connectors may have a skirt size on the order of one-half inch. Notwithstanding, in one embodiment, the skirt 44 extends away from the body 30 by an amount at least equal to a height of the body. In another embodiment, the skirt 44 extends away from the body 30 at least as far as the shortest length across the body 30. A one-half (½) inch expanse between the body 30 and the perimeter 49 is approaching the minimum distance permitted.

The tapered second portion 48 reduces stress concentrations within the housing 24 and provides a smooth transition between the connector pad 12 and the connector 22 which minimizes or eliminates abrupt dimensional variations in both the connector bondline (not shown), and the structure (such as the fuselage 18) in which the connector 22 is ultimately embedded.

The tapered second portion 48 extends at an angle which is preferably substantially equal to the angle of the tapered edges of the connector pad 12. Alternatively, the tapered second portion 48 may angle between about 30 and about 60 degrees and more preferably at an angle between about 40 and 50 degrees and most preferably at an angle of about 45 degrees relative to the first portion 46.

Although other shapes such as hemi-ellipsoidal and truncated conical may be employed, the skirt 44 is preferably pyramidal in shape, such as a truncated, right-rectangular pyramid, with rounded corners 50 between adjacent sidewalls 51. The radii of curvature of the corners may be equal to one another but preferably are made to compliment the shape of the connector pad 12 to which the skirt 44 is eventually bonded.

Although other thickness are available, the skirt 44 is preferably about 0.040 inches thick. This thickness compliments the 0.070 inch thick connector pad 12 to which the connector 22 is particularly well suited. Also, the skirt 44 is preferably about four by four inches although other sizes are certainly available. The exact size will depend on the number and size of connector pins employed and the pin-to-pin spacing desired.

Although other materials may be available, it is presently preferred to form the housing 24 from a high grade, conductively or semi-conductively reinforced resin such as Ultem (ULTEM is a registered trademark of General Electric Company) with a discontinuous graphite fiber reinforcement. Alternatively, Semitron ESd 410C (SEMITRON is a registered trademark of Quadrant Engineering Plastic Products) could be used. Semitron is a static dissipative polyetherimide. A conductive or semiconductive material is desired to help reduce and dissipate static charge build-up and provide shielding. Alternatively, a non-conductive resin could be used; ideally such a resin would be plated with a conductive coating to provide shielding and static charge dissipation. In the most preferred form, the connector 22 is formed to structurally and geometrically match the structure to which it is mounted. For example, if the mounting structure has a slight curvature, it may also be desirable to for the connector housing 24 with a matching curvature. Also, it is desirable to form the connector 22 with a stiffness modulus that is appropriately designed with the surrounding structure to provide a smooth transition in stiffness with the structure to which it is attached; thus providing a strong connector housing and attachment with minimally induced stress concentrations. In addition, it is ideal if the connector coefficient of thermal expansion is as close to that of the structure to which it is mounted as possible.

Further, while a one piece housing 24 is preferred, a two or more piece housing 24 could be provided by bonding the body 30 to a one or more piece skirt 44. Finally, it may be desirable to perform surface treatments to the skirt 44 to enhance its bond with the connector pad 12 and/or embedding within a structure.

The skirt 44 is provides a surface area to bond the connector to the structure. The size of the connector skirt will vary depending on the desired bonding area for securely holding the connector 22 to the connector pad 12 or the structure. Other factors affecting the connector skirt size are the size of the contact retainer 26 (which depends on the number and spacing of pins desired), the bonding characteristics for the material of the skirt 44, the adhesive properties, the connector pad 12 material bonding properties, and finally, the differential loads and strains between materials. Since the connector housing 24 is preferably a one-piece part, fabricated with low-cost processing such as molding, the skirt material will also desirably be a conductive or semi-conductive material.

The contact retainer 26 is generally rectangularly shaped and dimensioned to fit within the central orifice 32 of the housing 24. When disposed within the central orifice 32, the contact retainer 26 is spaced apart from the body 30 by a sufficient gap to allow the portion 35 of the mating connector 34 to snugly fit between the contact retainer 26 and the body 30.

The contact retainer 26 is preferably formed of a high grade dielectric to give it structural rigidity while not affecting electrical signal performance for high frequency signals. Alternatively, if low frequency signals or power signals are being employed, a slightly higher dielectric constant material may be used. A material with adequate dielectric strength is desired to prevent voltage breakdown. Further, it may be possible for the material of the contact retainer 26 to be the same material as that used for the housing 24. Elastomeric seals (not shown) are also desirable on the top and bottom of the contact retainer 26 to seal the connector 22 from the environment.

The contact retainer 26 includes a plurality of through holes 52 longitudinally extending therethrough. Preferably, the through holes 52 are disposed in an array including a plurality of parallel rows. The spacing between the through holes 52 is set to ensure sufficient impedance control and shielding of the pins 28. It should be noted, however, that some of the pins may be ground pins.

The through holes in the contact retainer 26 are dimensioned to retain the compliant pins 28 therein. The pins are inserted into the contact retainer 26 to align the pins 28 and should allow the pins 28 to be inserted within the connector pad 12 without mis-alignment or deformation but also allow the pins 28 to be removed from the contact retainer 26 if required for replacement or service. When properly inserted within the contact retainer 26, the pins 28 extend from one end and leave a void at the opposite end of the through holes 52.

The voids in the through holes 52 accommodate an array of sockets 53 from the mating connector 34. When installed, the contact retainer 26 rigidly ensures appropriate spacing for mating electrical connections among the sockets 53 of the mating connector 34 and the array of compliant pins 28. The compliant pins 28 shown do have pin features that insert into the plated through holes in the pad 12, and at the opposite end have socket contacts for interfacing with the mating connector. While one arrangement of the compliant pin socket contacts 28 and pin contacts 53 has been described, it should be noted that it is possible to have sockets in mating connector 34 (instead of pin contacts 53) and pin contacts (instead of compliant pins with socket contacts 28) in the connector 24. It is also possible to mix pins and socket contacts with both pins and sockets on one mating connector half.

The array of compliant pins 28 preferably includes a plurality of rows which are disposed so as to mate with the structurally integrated connector pad 12 and contact retainer 26. In operation, the compliant pins 28 make electrical contact with the flat wire 20 within the pad 12. The compliant pins 28 preferably include a spring feature that allows one end of each pin 28 to be inserted into the pad 12 with a strong friction fit. The other end of the pins 28 include a socket feature (or pin feature) for accepting the pins 53 of the mating connector 34.

The connector 22 is particularly well suited for working in conjunction with a structurally integrated connector pad such as the connector pad 12. While a brief description of the connector pad 12 will be given here, it should be appreciated that a more detailed description of the preferred connector pad can be found is U.S. patent application Ser. No. 10/394,784, entitled CONNECTOR INTERFACE PAD FOR STRUCTURALLY INTEGRATED WIRING, filed contemporaneously herewith, assigned to the assignee of the present application, and the entire disclosure of which is expressly incorporated by reference herein.

The connector pad 12 includes a base 54, a top 56 opposite the base 54, and tapered sidewalls 58 extending therebetween. The tapered shape of the connector pad 12 minimizes stress concentrations when the connector pad 12 is bonded into, or on the surface of a structure such as the fuselage 18 in FIG. 1.

An end 60 of the flat circuit wiring 20 is sandwiched within the pad 12. A plurality of plated-through holes 62 formed in the top 56 provide access to the structurally integrated wiring array 20. The through holes 62 are generally plated with copper and tinned with solder to provide connectivity to the signal wiring, power wiring, or ground layers located in the pad. The through holes 62 are shaped to compliment and removably retain the array of pins 28 extending from the connector 22 therein.

As illustrated in FIG. 3, the through holes 62 in the pad 12 enable the compliant pins 28 to pass from the top 56 of the connector pad 12 through the wiring array 20 to establish electrical connection therebetween. In this way, the connector 22 provides an interface for interconnecting the structurally integrated wiring array 20 with non-structurally integrated wiring via the compliant pins 28, connector 22, and mating connector 34 (see FIG. 2).

FIG. 3 also illustrates a configuration of the present invention wherein the connector 22 is embedded within a structure in the form of the fuselage 18. An opening 64 in the fuselage 18 provides access to the through holes 62 so that the compliant pins 28 may be inserted therein. As can be seen, the tapered second portion 48 of the skirt 44 mates flush with inversely tapering edges of the fuselage 18.

The connector 22 is preferably secured to the connector pad 12 by securing the skirt 44 to the top 56. This may be accomplished by an adhesive or the like. By manufacturing the connector 22 as a separate component from the pad connector 12, a rigid connector 22 can be provided for a flexible pad connector 12.

Thus, a connector is provided including a body having a central orifice and a skirt laterally projecting from a periphery of the body. A contact retainer is disposed within the central orifice and includes an array of through holes formed therethrough. An array of contacts in the form of compliant pins or sockets is disposed within the through holes of the contact retainer. The central orifice is adapted to receive a mating connector such that an array of contacts associated with the mating connector insert within the through holes of the contact retainer to make electrical contact with the array of contacts in the contact connector. The connector provides a durable transition from structurally integrated wiring to non-structurally integrated wiring. The connector includes a large skirt to enable bonding to or within a structure, as well as rounded corners and tapering to minimize stresses imparted on the structure, the contact retainer, and the wiring.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A connector comprising:

a body having an orifice formed therethrough; and a skirt laterally extending about a periphery of said body by an amount at least equal to a distance across a shortest width of said body, said skirt including:

a first annular portion planarly extending from said body; and a second annular portion radially extending from said first annular portion, said second annular portion being tapered.

2. The connector of claim 1 wherein a junction between said body and said skirt is arcuate.

3. The connector pad of claim 1 wherein said skirt is structurally integrated with a structure to which said connector is mounted.

4. The connector of claim 1 further comprising:

a contact retainer disposed within the orifice of the body; and an array of contacts inserted within said contact retainer.

5. The connector of claim 4 wherein said contact retainer includes a plurality of through holes formed therein accommodating said array of contacts.

6. A connector comprising:

a body having an orifice formed therethrough;

a skirt laterally extending about a periphery of said body by an amount at least equal to a distance across a shortest width of said body; and a flat wire connector pad bonded to said skirt.

7. A connector comprising:

a body having an orifice formed therethrough;

a skirt laterally extending about a periphery of said body by an amount at least equal to a distance across a shortest width of said body;

a contact retainer disposed within the orifice of the body; and an array of contacts inserted within said contact retainer, said contact retainer including a plurality of through holes formed therein accommodating said array of contacts; and a mating connector coupled to said body, said mating connector including a plurality of contacts passing into said contact retainer and contacting said array of contacts.

8. A connector assembly comprising:

a housing including:

a generally rectangularly shaped body having a central orifice formed therethrough; and an annular skirt extending laterally from said body, said skirt including:

a first annular portion radially projecting alone a substantially orthogonal plane from said body; and a second annular portion radially extending from said first annular portion, said second annular portion being tapered;

a generally rectangular contact retainer disposed within the orifice of the body, said contact retainer including an array of through holes formed therethrough; and an array of contacts inserted within said array of through holes of said contact retainer.

9. The connector assembly of claim 8 wherein said skirt is integrally formed with said body and a junction between said body and said skirt is arcuate.

10. A connector assembly comprising:

a housing including:

a generally rectangularly shaped body having a central orifice formed therethrough; and an annular skirt extending laterally from said body;

a generally rectangular contact retainer disposed within the orifice of the body, said contact retainer including an array of through holes formed therethrough; and an array of contacts inserted within said array of through holes of said contact retainer;

wherein said skirt further comprises:

a first portion extending generally orthogonally from said body; and a second portion extending from said first portion, said second portion being tapered at a rate substantially equal to a taper of a tapered portion of a connector pad to which the pin connector is matched.

11. A connector assembly comprising:

a housing including:

a generally rectangularly shaped body having a central orifice formed therethrough; and an annular skirt extending laterally from said body;

a generally rectangular contact retainer disposed within the orifice of the body, said contact retainer including an array of through holes formed therethrough;

an array of contacts inserted within said array of through holes of said contact retainer; and a connector pad secured to said skirt opposite said body and receiving said array of compliant pin contacts therein.

12. The connector assembly of claim 11 wherein said array of compliant pin contacts connect to a wiring array disposed within said connector pad.

13. A connector assembly comprising:

a housing including:

a generally rectangularly shaped body having a central orifice formed therethrough; and an annular skirt extending laterally from said body;

a generally rectangular contact retainer disposed within the orifice of the body, said contact retainer including an array of through holes formed therethrough;

an array of contacts inserted within said array of through holes of said contact retainer; and a mating connector coupled to said housing, said mating connector including:

a portion nesting within said body and encircling said contact retainer; and a plurality of contacts within said portion inserted within said plurality of through holes of said contact retainer and contacting said array of contacts.

14. The connector assembly of claim 13 wherein said skirt is embedded within or bonded to the surface of a structure to which said connector is mounted.

15. A connector assembly for a vehicle comprising:

a structural member of the vehicle;

an electronic device integrated with said structural member;

a wiring array extending from said electronic device and integrated with said structural member;

a connector pad coupled to said wiring array and integrated with said structural member; and a connector mounted to said connector pad, said connector including:

a body having an orifice formed therethrough; and a skirt extending laterally from a periphery of said body;

a contact retainer disposed within the orifice of the body, said contact retainer including an array of through holes formed therethrough; and an array of contacts inserted within said array of through holes of said contact retainer.

16. The connector assembly of claim 15 wherein said skirt further comprises:

a first portion extending from said body; and a second portion extending from said first portion, said second portion being tapered.

17. The connector assembly of claim 16 wherein said second portion tapers at a rate substantially equal to a taper of a tapered portion of said connector pad.

18. The connector assembly of claim 18 wherein said skirt is integrated with said structure.

* * * * *

UNITED STATES PATENT AND TRADEMARK OFFICE

CERTIFICATE OF CORRECTION

PATENT NO. : 6,752,632 B1
APPLICATION NO. : 10/393744
DATED : June 22, 2004
INVENTOR(S) : Anderson et al.

It is certified that error appears in the above-identified patent and that said Letters Patent is hereby corrected as shown below:

Title Page #54

Please correct the title of the application to read as follows:

--COMPLIANT PIN CONNECTOR FOR STRUCTURALLY INTEGRATED WIRING--.

Signed and Sealed this

Nineteenth Day of September, 2006

JON W. DUDAS
*Director of the United States Patent and Trademark Office*